US008235344B1

(12) United States Patent
Bergin

(10) Patent No.: US 8,235,344 B1
(45) Date of Patent: Aug. 7, 2012

(54) GUITAR HOLDER

(76) Inventor: Peter W. A. Bergin, Rancho Mirage, CA (US)

( * ) Notice: Subject to any disclaimer, the term of this patent is extended or adjusted under 35 U.S.C. 154(b) by 271 days.

(21) Appl. No.: 12/567,891

(22) Filed: Sep. 28, 2009

Related U.S. Application Data

(60) Provisional application No. 61/100,562, filed on Sep. 26, 2008.

(51) Int. Cl.
*A47B 91/00* (2006.01)

(52) U.S. Cl. ..... 248/349.1; 248/346.06

(58) Field of Classification Search ..... 248/349.1, 248/346.5, 346.03, 346.01, 299.1, 346.06; 84/453, 421, 327; 211/85.6; 269/3, 6, 95, 269/143, 71, 55, 60, 260, 261; 108/22, 94, 108/103, 139, 142
See application file for complete search history.

(56) References Cited

U.S. PATENT DOCUMENTS

| | | | | |
|---|---|---|---|---|
| 4,037,815 | A | 7/1977 | DeLano | |
| 4,742,751 | A | 5/1988 | Cherry | |
| 5,121,890 | A | 6/1992 | Komada | |
| 5,660,361 | A * | 8/1997 | Penger | 248/131 |
| 6,281,417 | B1 | 8/2001 | Ladao | |
| 6,685,283 | B2 | 2/2004 | Gembar et al. | |
| 7,712,719 | B2 * | 5/2010 | Derry et al. | 248/346.06 |
| 7,770,859 | B2 * | 8/2010 | Costabel et al. | 248/316.5 |
| 7,866,623 | B2 * | 1/2011 | Lampman et al. | 248/551 |
| D636,397 | S * | 4/2011 | Green | D14/447 |
| 2006/0081110 | A1 | 4/2006 | Bridges | |
| 2006/0081111 | A1 | 4/2006 | Bridges | |
| 2006/0255229 | A1 * | 11/2006 | Cheng | 248/458 |
| 2007/0096002 | A1 * | 5/2007 | Knight | 248/460 |

* cited by examiner

*Primary Examiner* — A. Joseph Wujciak, III

(74) *Attorney, Agent, or Firm* — Westman, Champlin & Kelly, P.A.; Z. Peter Sawicki

(57) ABSTRACT

A guitar holder comprising a mounting member for mounting to a structure, a main body rotatably attached to the mounting member for angularly rotating the main body with respect to the structure, and two arm portions extending from the main body in generally opposing directions with each arm portion having a guitar engaging end for attachably engaging a guitar and at least one arm portion being adjustably extendable from the main body to accommodate guitars of different sizes.

22 Claims, 7 Drawing Sheets

GUITAR HOLDER

CROSS-REFERENCE TO RELATED APPLICATION

The present application is based on and claims the benefit of U.S. provisional patent application Ser. No. 61/100,562 filed Sep. 26, 2008, the content of which is hereby incorporated by reference in its entirety.

BACKGROUND OF THE INVENTION

Guitars are popular instruments. Storing a guitar other than in a guitar case can prove to be cumbersome. It is sometimes desirable to have a guitar in full view and be able to reach and take the guitar and play it.

In addition, there are those who collect guitars and of course keeping a guitar in a guitar case does not help in displaying the guitar.

There are a number of patents and published patent applications that describe guitar holders. The patents include the DeLano U.S. Pat. No. 4,037,815, Cherry U.S. Pat. No. 4,742,751, the Komada U.S. Pat. No. 5,121,890, the Ladao U.S. Pat. No. 6,281,417, the Gembar et al. U.S. Pat. No. 6,685,283, the and the Bridges U.S. Published Patent Applications 2006/0081111 and 2006/0081110. However, each of the guitar displays or holders that are described in the above have their drawbacks.

BRIEF SUMMARY

A guitar holder comprising a mounting member for mounting to a structure, a main body rotatably attached to the mounting member for angularly rotating the main body with respect to the structure, and two arm portions extending from the main body in generally opposing directions with each arm portion having a guitar engaging end for attachably engaging a guitar and at least one arm portion being adjustably extendable from the main body to accommodate guitars of different sizes.

BRIEF DESCRIPTION OF THE DRAWINGS

The disclosed subject matter will be further explained with reference to the attached figures, wherein like structure or system elements are referred to by like reference numerals throughout the several views.

While the above-identified figures set forth one or more embodiments of the disclosed subject matter, other embodiments are also contemplated, as noted in the disclosure. In all cases, this disclosure presents the disclosed subject matter by way of representation and not limitation. It should be understood that numerous other modifications and embodiments can be devised by those skilled in the art which fall within the scope and spirit of the principles of this disclosure.

The figures may not be drawn to scale. Moreover, where terms such as above, below, over, under, top, bottom, side, right, left, etc., are used, it is to be understood that they are used only for ease of understanding the description. It is contemplated that structures may be otherwise oriented.

DETAILED DESCRIPTION OF ILLUSTRATIVE EMBODIMENTS

Figure 1:
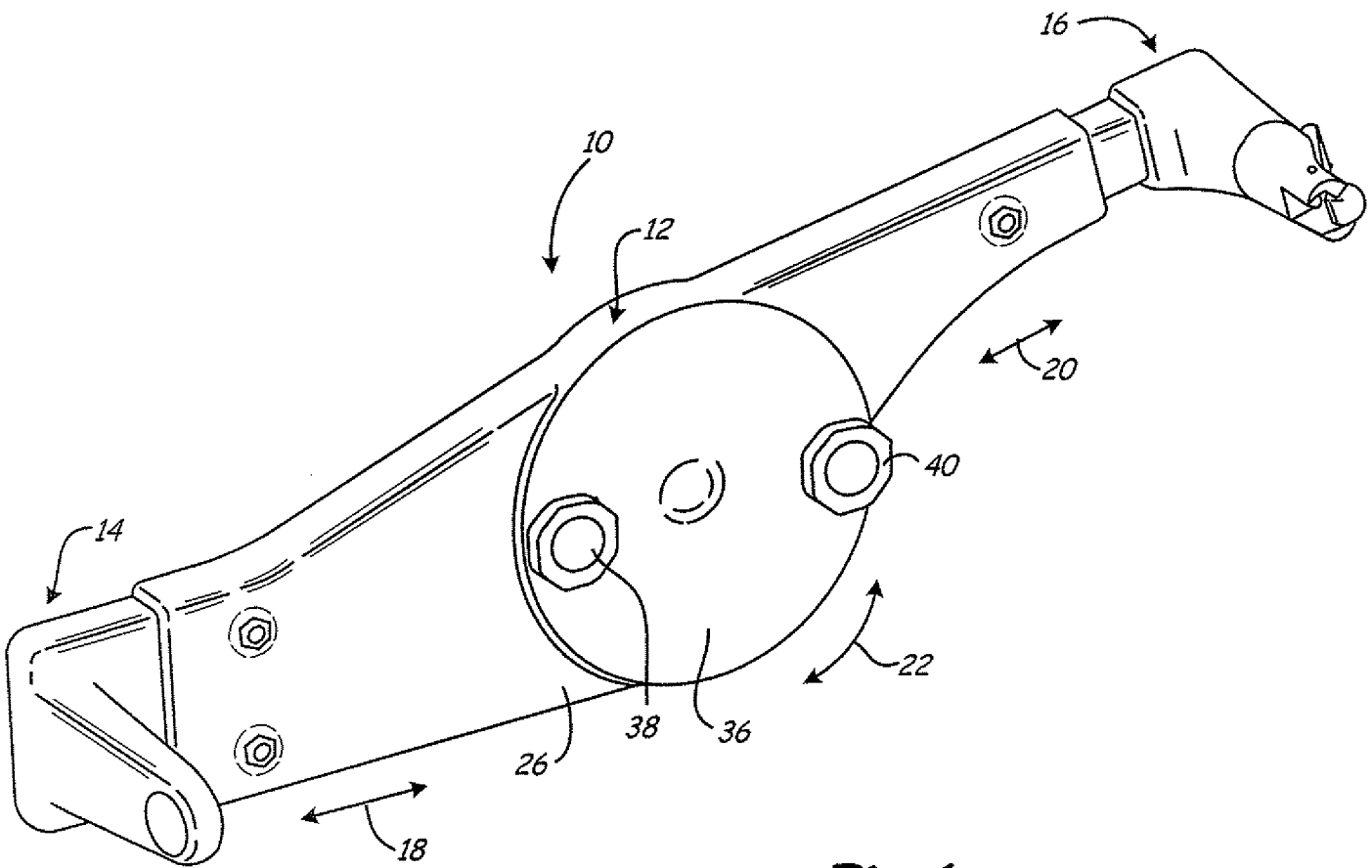
FIG. 1 is a perspective view of an exemplary guitar holder of the present disclosure.

The guitar holder of the present disclosure is generally indicated at reference numeral 10 in FIG. 1. The guitar holder 10 is a device used to hang a guitar from structure such as a wall. The guitar holder 10 is illustrated in exploded views in FIGS. 2-3. The holder 10 includes a main body portion 12, a lower body strap nut holder (lower arm portion) 14 and an upper body (near the guitar neck) strap nut holder (upper arm portion) 16. The guitar holder 10 holds the guitar by engaging the strap nuts of the guitar which are typically engaged by the shoulder strap (not shown) of the guitar. The holder 10 is configured to hold most guitar configurations since both holders 14 and 16 can be adjusted in the directions of arrows 18 and 20 to accommodate guitars having bodies of different lengths. In addition, the main body 12 may be rotated in the directions of arrow 22 for securing the guitar to a wall in different angular positions.

Figure 2:
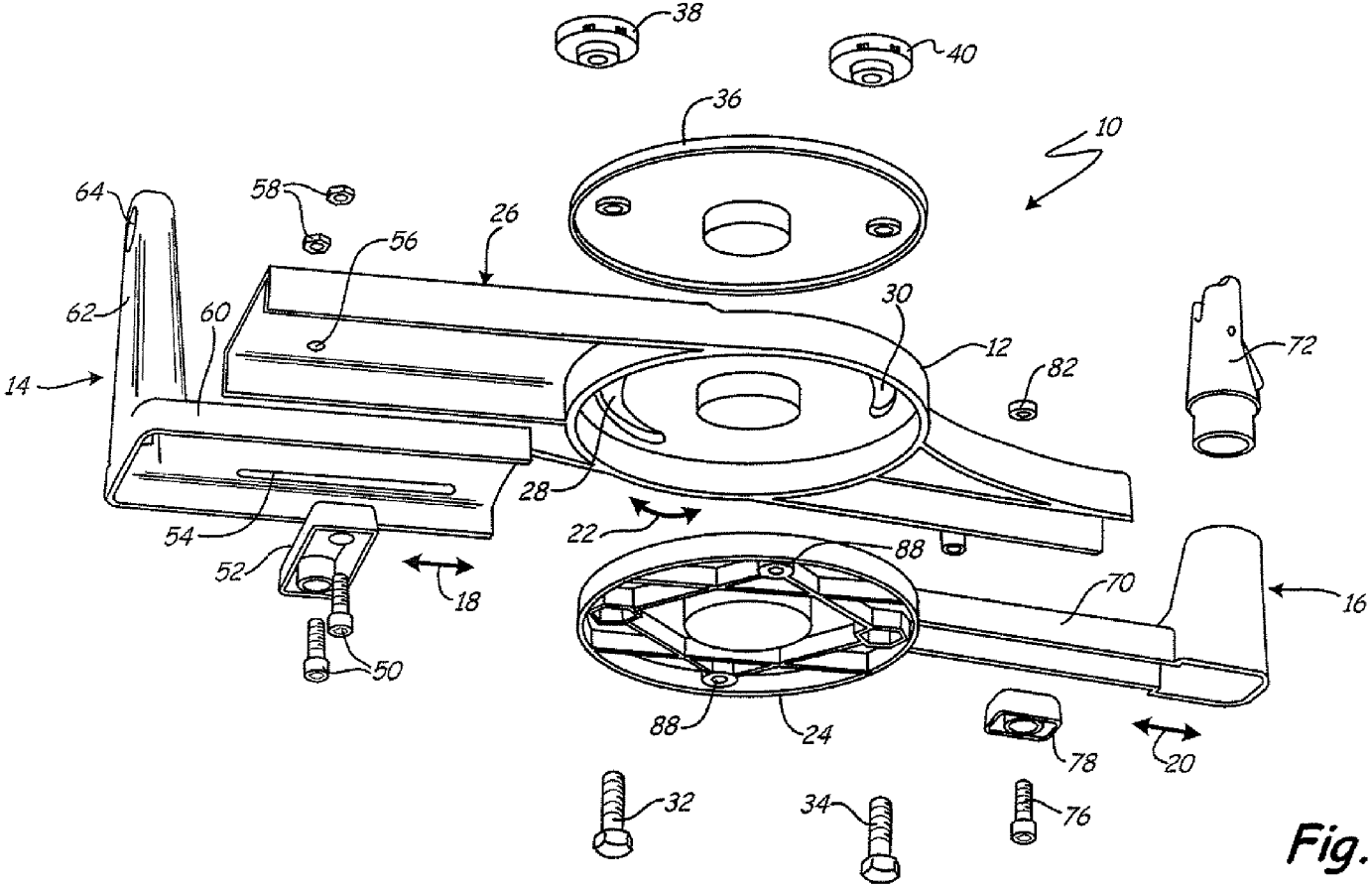
FIG. 2 is an exploded bottom perspective view of the guitar holder of FIG. 1.
Figure 3:
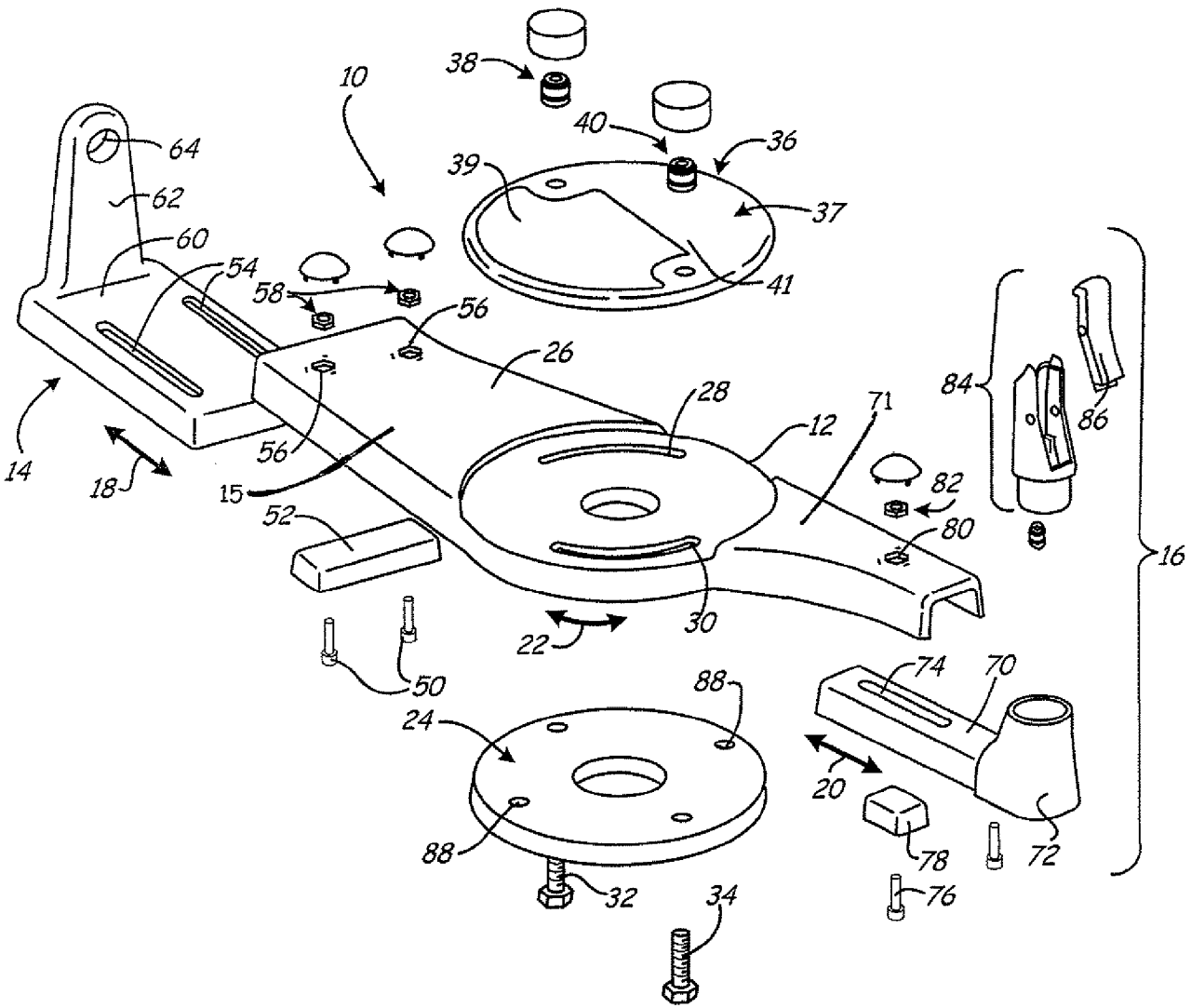
FIG. 3 is an exploded top perspective view of the guitar holder of FIG. 1.

Referring to FIGS. 2 and 3, the main body 12 is attached to a mounting member such as wall mounting plate 24. Wall mounting plate 24 is engaged by a main body cover plate 26 that has arcuate shaped slots 28 and 30 and first and second arm portions extending in substantially opposite directions from main body 12. Bolts 32 and 34 extend through the wall mounting plate 24 and engage the slots 28 and 30, extending therethrough and into apertures of a disc cover plate 36. The ends of the bolts 32 and 34 are engaged by decorative nuts 38 and 40. It will be appreciated that the main body cover plate 26 is rotatable about the wall plate 24 in the direction of arrow 22 through cooperation of the bolt protrusions 32 and 34 extending through arcuate slots 28 and 30. When the nuts 38 and 40 are tightened against the disc cover plate 36, the cover plate 26 is secured in a selected angular position to display the guitar on a wall at the selected angular position. While bolts and nuts are described as fastening members is an illustrative embodiment, it is contemplated that other known fasteners may also be used.

The disc cover plate 36 may have advertising or other promotional indicia disposed on its face 37. In one specific example, which should not be used to limit this disclosure, a depressed area 39 is molded on the cover plate 36 for providing an area for advertising or other promotional indicia. In addition, the trademark of the guitar holder may also be placed on the disc cover plate 36 in a location as indicated by reference numeral 41 in a manner such as molding or printing.

The position (length) of the lower nut strap holder 14 may be adjusted by sliding the holder 14 into a lower sleeve-like end 15 with respect to the cover plate member 26, in the directions of arrow 18. The holder 14 is attached to the sleeve-like end 15 through the use of a pair of bolts 50 extending through apertures in the block 52, and then through slots 54 in the holder 14. The bolts 50 then extend through apertures 56 in the sleeve-like end 15 as illustrated in FIGS. 2 and 3 and are engaged by decorative nuts 58.

The holder 14 comprises a slide member 60 in which the slots 54 are positioned and a strap nut engaging end portion 62 oriented approximately 90° to the linearly extendable slide member 60. The slide member 60 extends into the lower sleeve-like end 15 and can be adjusted in the direction of arrow 18 to increase or decrease the length the holder 14 sticks out from the main body 26.

The end portion 62 has a guitar strap nut engaging aperture 64. In an exemplary embodiment, the strap nut engaging aperture 64 provides a snap fit to engage the strap nut of the lower body of the guitar. In essence, the strap nut has a cross-sectional bulb shaped configuration and the aperture 64 has a flexible annularly shaped engaging portion whose diameter is slightly smaller than the largest diameter of the strap nut of the guitar. Therefore, when the strap nut is inserted into the aperture 64, the flexible edge gives way and engages the smaller diameter of the strap nut. The holder 14 is placed in a selected position by simply sliding member 60 with respect to the cover plate 26 and tightening the nuts 58, thereby frictionally engaging the holder 14 with the plate 26.

Figure 4:
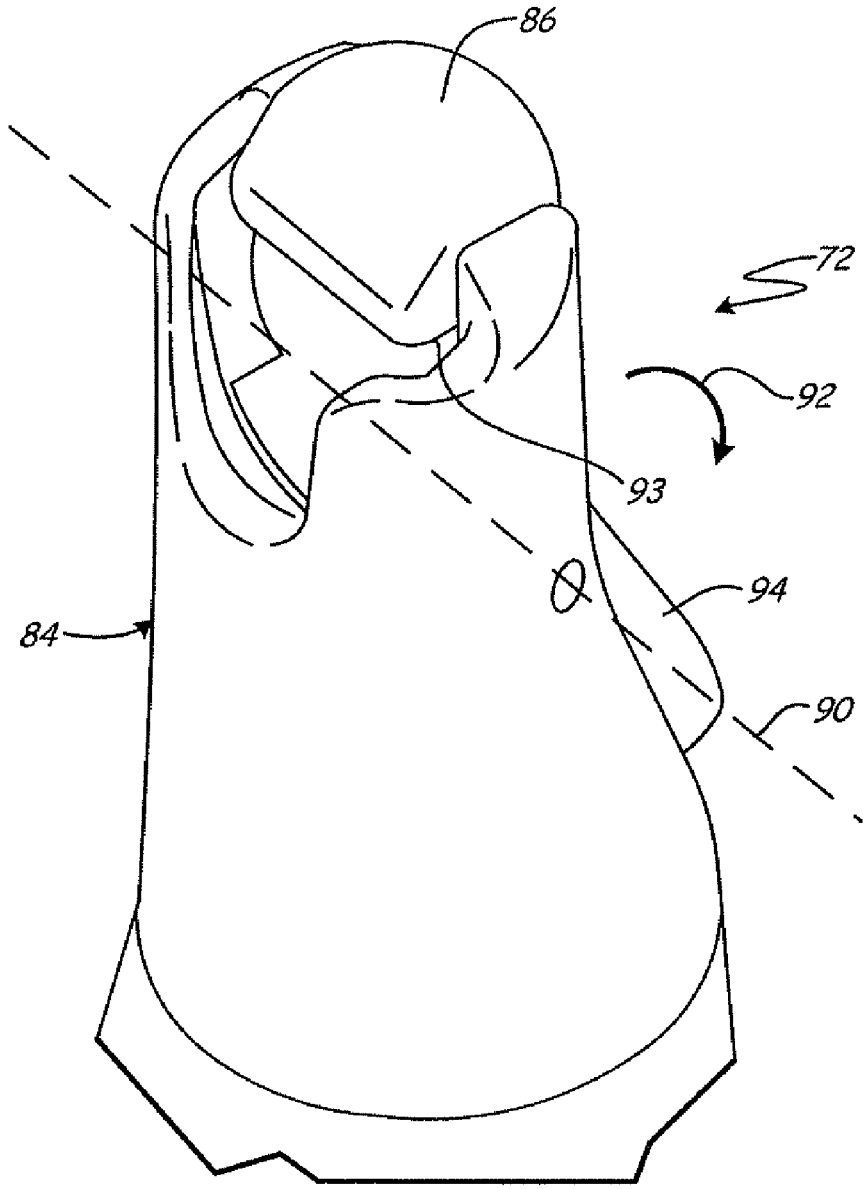
FIG. 4 is a perspective view of one side of an upper body strap nut engaging portion of the guitar holder of FIG. 1.
Figure 5:
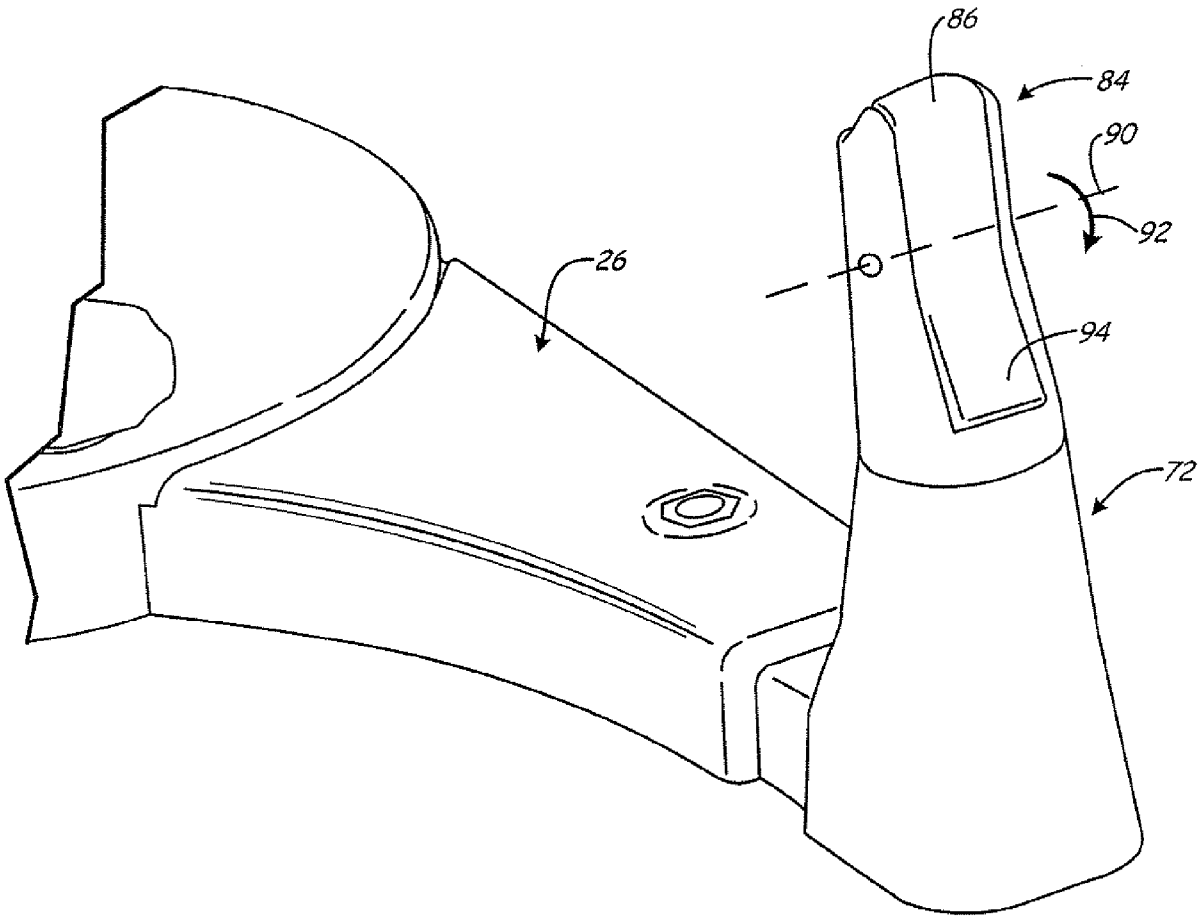
FIG. 5 is a perspective view of the other side of the upper body strap nut engaging portion of FIG. 4.

The neck strap nut holder (upper arm portion) 16 includes a linearly extendable slide portion 70 and a strap nut engaging portion 72 oriented approximately 90° with respect to the slide portion 70. The slide portion 70 extends into a sleeve-like end 71 of the main body 26. The portion 70 includes a slot 74 that is engaged by a bolt 76. The bolt 76 extends through a block 78, through the slot 74 and through an aperture 80 in the plate 26. The end of the bolt 76 is engaged by a nut 82. Loosening the nut 82 permits sliding the holder 16 in and out of the sleeve-like end 71 thereby adjusting the length that holder extends out of the main body 26. The neck strap engaging portion 72 further includes a neck strap nut engaging end 84 having a spring biased clip 86 as best illustrated in FIGS. 4-5.

Figure 6:
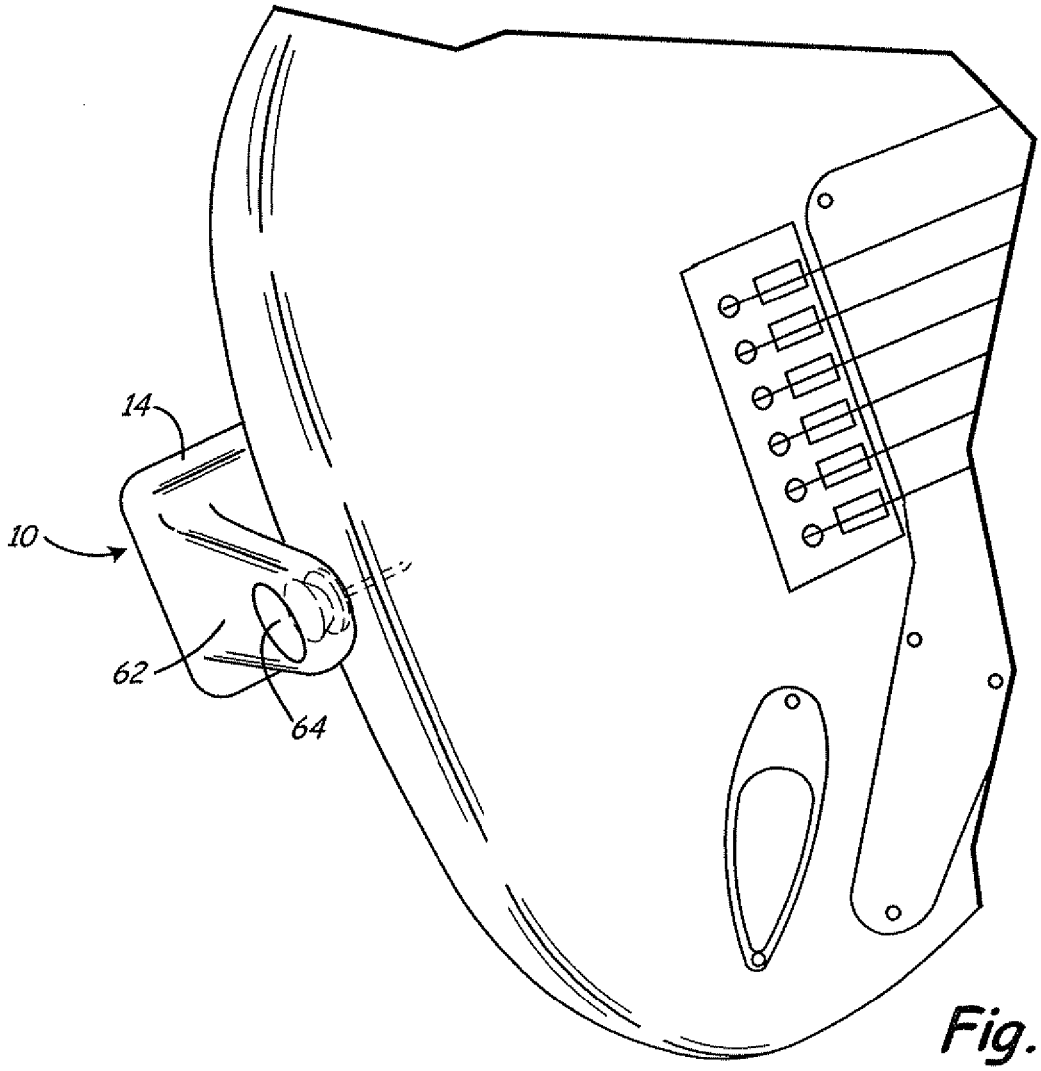
FIG. 6 is a partial perspective view of a guitar with its lower body strap nut engaged in a lower body strap nut holder of the guitar holder of FIG. 1.
Figure 7:
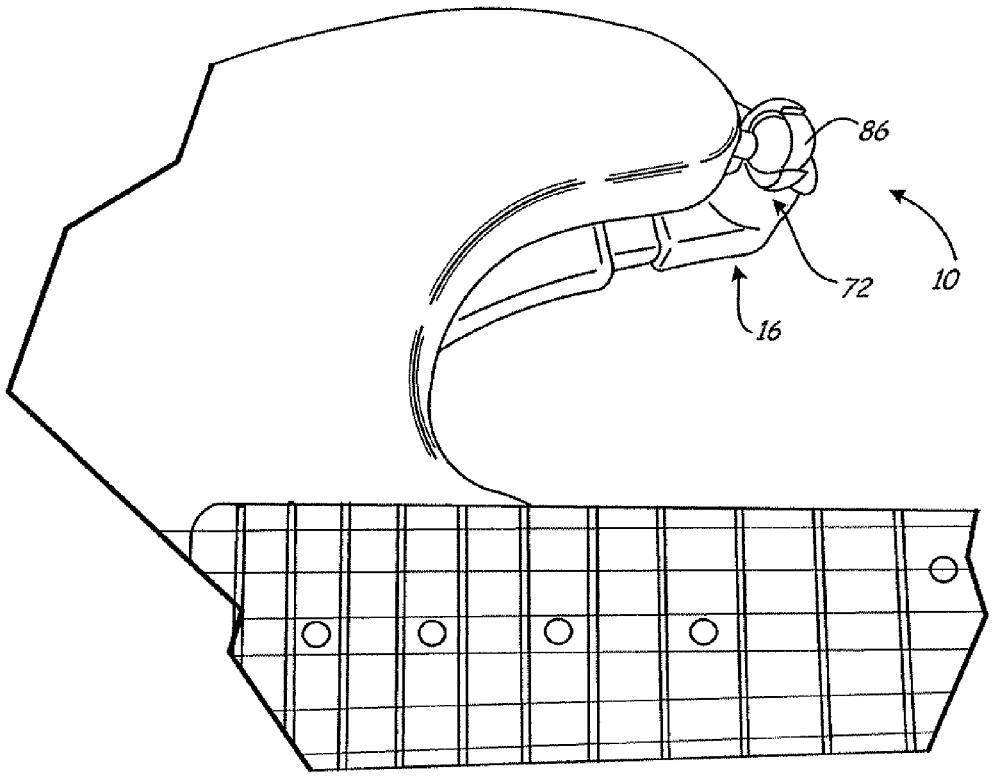
FIG. 7 is a partial perspective view of a guitar with its upper body strap nut engaged in an upper body strap nut holder of the guitar holder of FIG. 1.

To fit a guitar to the guitar holder 10 of the present disclosure, the holders 14 and 16 are in a loose and adjustable position (not frictionally engaging the plate 26). The holders 14 and 16 are slidably adjusted with respect to the cover plate 26 to engage the strap nuts of the guitar as illustrated in FIGS. 6 and 7. This affects the overall length of holder 10. The length of holder 10 is then fixed by tightening bolt and nut assemblies 76/82 to secure the holder 16 in position with respect to plate 26 and tightening bolt and nut assemblies 50/58 so that holder 14 is also secured in position with respect to plate 26. After the holders 14 and 16 are secured in position, the guitar is released from the holder 10 by disengaging the guitar's strap nuts from strap nut holders 14, 16. The length of holder 10 can be adjusted for different size guitars as desired by loosening and retightening bolt and nut assemblies 76/82 and 50/58.

Holder 10 is then mounted to the wall by securing wall plate 24 to the wall. This may be accomplished, for example, by inserting bolts 32 and 34 through wall plate 24 and then by passing nails or screws through apertures 88 of wall plate 24 into the wall. The cover plate 26 is then secured to the wall plate 24 with bolts 32 and 34 extending through slots 28 and 30, respectively. The disc cover 36 is then secured by bolts 32 and 34 and nuts 38 and 40 are then tightened. Prior to tightening the nuts 38 and 40, the angular position of cover plate 26 can be adjusted by rotating plate 26 about the mounting plate 24 in the directions of arrow 22. In an exemplary embodiment, the cover plate 26 can be rotated approximately 60°. However, further rotation (such as 180°) is also included within this disclosure. The use of bolts 32 and 34 as protrusions in cooperation with arcuate slots 28 and 30 allows for an infinite selection of angular positions within the range of motion. Nuts 38 and 40 may be loosened and retightened to allow for subsequent adjustments of the angular position of cover plate 26 with respect to wall mounting plate 24 (and thus the angular position of a guitar held on the wall by holder 10).

The guitar can be engaged and disengaged from the holder 10. In an exemplary method, the guitar is engaged or placed in the holder 10 by first inserting the guitar's lower body strap nut into aperture 64 of the lower body strap nut holder 14. In an exemplary method, the strap nut snaps into place. Then the strap nut nearest the neck of the guitar is pressed against spring biased clip 86 of strap nut engaging portion 72, shown in FIGS. 4 and 5. This causes clip 86 to pivot in the direction of arrow 92 about pivot axis 90. After the strap nut passes under lip 93 of clip 86, the spring force biases clip 86 back in the direction opposite 92 and the strap nut is held in place by lip 93 of clip 86.

To release the guitar, the clip 86 is pivoted away from the strap nut by pushing against the lower part of the clip 94 in direction 92. This releases the strap nut at upper body strap nut holder 16. Then the guitar may be pulled out of its snap fit within aperture 64 of the lower body strap nut holder 14.

In an alternative attachment method, the guitar's lower body strap nut is engaged within aperture 64 of holder 14. Then, the user pivots the clip 86 away from the guitar's upper strap nut by pushing against the lower part of the clip 94 in direction 92. Thus, the upper body strap nut may be placed within engaging portion 72 with very little force, thus reducing potential for damage to the instrument. Then, the user releases lower part 94 to secure the guitar's upper strap nut within engaging portion 72.

Although the present disclosure has been described with reference to preferred embodiments, workers skilled in the art will recognize that changes may be made in form and detail without departing from the spirit and scope of the invention. For example, while strap nut holder 14 has been described as a lower body strap nut holder and strap nut holder 16 has been described as a upper body strap nut holder, it is contemplated that the guitar, holder, and wall may be placed in other orientations with respect to each other.

What is claimed is:

1. A guitar holder comprising:

a mounting member for mounting to a structure;

a main body rotatably attached to the mounting member for angularly rotating the main body with respect to the structure and wherein the main body includes at least two slots and further including a pair of fasteners extending through the slots and engaging the mounting member whereby if the fasteners are loosened, the main body is rotatable with respect to the mounting member and when the fasteners are tightened the main body is held in a selected position with respect to the mounting member; and two arm portions extending from the main body in generally opposing directions with each arm portion having a guitar engaging end for attachably engaging a guitar and at least one arm portion being adjustably extendable from the main body to accommodate guitars of different sizes.

2. The guitar holder of claim 1 wherein the main body has two sleeve-like ends extending in opposing directions and wherein the two arm portions slideably engage the sleeve-like portions.

3. The guitar holder of claim 1 wherein at least one of the arm portions is retained in a selected position with respect to its respective sleeve by a fastener extending through the sleeve and engaging the respective arm portion.

4. The guitar holder of claim 3 wherein both arm portions are engaged by fasteners extending through their respective sleeves and engaging the respective arm portions to hold the arm portions in selected extended positions with respect to the main body.

5. The guitar holder of claim 1 and further comprising a cover plate for covering the slots and the fasteners from view.

6. The guitar of claim 5 and further comprising an area on the cover plate for placement of indicia.

7. The guitar holder of claim 1 wherein one of the arm portions includes a spring bias clip for engaging a guitar nut.

8. The guitar holder of claim 7 wherein the spring biased clip comprises a lip that engages a guitar nut.

9. The guitar holder of claim 7 wherein the spring biased clip pivots about an axis.

10. A guitar holder comprising:

a mounting member for mounting to a structure;

a main body rotatably attached to the mounting member, the main body comprising at least one arcuate slot;

a fastener extending from the mounting member and through the slot, the fastener being capable of holding the main body against a mounting member such that the main body is held in a selected angular position;

a first arm portion extending from the main body and having a first guitar engaging end; and a second arm portion extending from the main body on a side substantially opposite the first arm portion and having a second guitar engaging end.

11. The guitar holder of claim 10 wherein at least one of the arm portions is retained in a selected position with respect to its respective sleeve by a fastener extending through the sleeve and engaging the respective arm portion.

12. The guitar holder of claim 11 wherein both arm portions are engaged by fasteners extending through their respective sleeves and engaging the respective arm portions to hold the arm portions in selected extended positions with respect to the main body.

13. The guitar holder of claim 10, wherein the second guitar nut engaging end comprises a spring biased clip.

14. The guitar holder of claim 13 wherein the spring biased clip comprises a lip that engages a guitar nut.

15. The guitar holder of claim 13 wherein the spring biased clip pivots about an axis.

16. A guitar holder comprising:

a mounting member for mounting to a structure;

a main body rotatably attached to the mounting member for angularly rotating the main body with respect to the structure; and two arm portions extending from the main body in generally opposing directions with each arm portion having a guitar engaging end for attachably engaging a guitar and at least one arm portion being adjustably extendable from the main body to accommodate guitars of different sizes wherein one of the arm portions includes a spring bias clip for engaging a guitar nut and wherein the spring biased clip comprises a lip that engages a guitar nut.

17. The guitar holder of claim 16 wherein the main body has two sleeve-like ends extending in opposing directions and wherein the two arm portions slideably engage the sleeve-like portions.

18. The guitar holder of claim 16 wherein at least one of the arm portions is retained in a selected position with respect to its respective sleeve by a fastener extending through the sleeve and engaging the respective arm portion.

19. The guitar holder of claim 18 wherein both arm portions are engaged by fasteners extending through their respective sleeves and engaging the respective arm portions to hold the arm portions in selected extended positions with respect to the main body.

20. The guitar holder of claim 16 wherein the main body includes at least two arcuate slots and further including a pair of fasteners extending through the arcuate slots and engaging the mounting member whereby if the fasteners are loosened, the main body is rotatable with respect to the mounting member and when the fasteners are tightened the main body is held in a selected position with respect to the mounting member.

21. The guitar holder of claim 20 and further comprising a cover plate for covering the slots and the fasteners from view.

22. The guitar holder of claim 21 and further comprising an area on the cover plate for placement of indicia.

* * * * *